US005636715A

United States Patent [19]

Hayashi et al.

[11] Patent Number: 5,636,715

[45] Date of Patent: Jun. 10, 1997

[54] ELEVATOR DOOR STRUCTURE AND METHOD OF ADJUSTING THE SAME

[75] Inventors: Yoshikatsu Hayashi; Masami Yoshikawa, both of Aichi, Japan

[73] Assignee: Mitsubishi Denki Kabushiki Kaisha, Tokyo, Japan

[21] Appl. No.: 368,642

[22] Filed: Jan. 4, 1995

[30] Foreign Application Priority Data

Mar. 10, 1994 [JP] Japan ..... 6-039909

[51] Int. Cl.[6] ..... B66B 13/12

[52] U.S. Cl. ..... 187/330; 49/120

[58] Field of Search ..... 187/319, 330, 187/313, 314; 49/120, 122

[56] References Cited

U.S. PATENT DOCUMENTS 3,912,049 10/1975 Holland et al. ..... 187/319
4,947,964 8/1990 Husmann ..... 18/319

FOREIGN PATENT DOCUMENTS 62-171886 7/1987 Japan .
5213569 4/1992 Japan .
5-213569 8/1993 Japan .
6-144752 5/1994 Japan .
62171886 7/1994 Japan .

*Primary Examiner*—Kenneth Noland

[57] ABSTRACT

The invention concerns a door structure for an elevator which allows a service engineer to easily adjust a gap between a vibration damping engaging mechanism on a cage sliding door, the width of which varies through the opening/closing operation of the cage sliding door, and each of vibration damping members spaced predetermined distances apart from both sides of the vibration damping engaging mechanism. In the door structure, the vibration damping engaging mechanism includes movable engaging vanes spaced predetermined distances apart from the vibration damping members. The movable engaging vanes are operated such that when the sliding door is present near to the full close and open positions, the spaces are larger than those when the sliding door is present in the middle of the opening/closing stroke of the sliding door.

14 Claims, 13 Drawing Sheets

ELEVATOR DOOR STRUCTURE AND METHOD OF ADJUSTING THE SAME

BACKGROUND OF THE INVENTION

The present invention relates to a door structure for an elevator, which is for laterally opening and closing an entranceway of an elevator from and toward the center thereof, and a method for adjusting the door structure.

FIGS. 12 through 17 show a door structure for an elevator developed by one of the present inventors and disclosed in Japanese Patent Kokai Publication No. Hei. 6-144752, published on May 24, 1994. FIG. 12 is a cross sectional view showing a key portion of an elevator. FIG. 13 is a front view showing a cage door structure in FIG. 12, as viewed from the platform. FIG. 14 is a front view showing a platform door structure in FIG. 12 when viewed from an elevator path. FIG. 15 is an enlarged view showing a portion A in FIG. 13. FIGS. 16 and 17 are enlarged views showing a portion B in FIG. 12. In those figures, like reference numerals designate like or equivalent portions.

The construction of a cage door structure will be described with reference to FIGS. 12 and 13. In the figures, reference numeral 1 designates a cage of an elevator; 2, an entranceway of the cage 1; 3 and 4, sliding doors horizontally slidable at the entranceway 2; 5 and 6, hanger plates for supporting the hanger plates 5 and 6 in a suspending fashion; 7 and 8, hanger rollers of which the shafts are supported by the hanger plates 5 and 6; and 9, a rail. The sliding doors 3 and 4 are supported so as to be movable in the entranceway direction through the hanger rollers 7 and 8. Reference numerals 10 and 11 designate rollers for preventing the hanger rollers 7 and 8 from slipping off the rail 9. These rollers are located in contact with the lower side of the rail 9. Reference numeral 12 designates a cross beam, and the rail 9 is fastened to a lower beam 13 thereof. Reference numeral 14 designates a door motor, and a drive force generated by the door motor 14 is transferred to the sliding doors 3 and 4, through a belt 15, a chain 16 and a 4-string link 17. Reference numeral 18 designates a belt wheel; 19, a chain pulley; 20, a crank arm fastened to the chain pulley 19; 21, a coupling arm for coupling a drive arm 22 with the crank arm 20. Reference numeral 23 indicates a follower arm, which is coupled with the drive arm 22 by a coupling bar 24, and converts a motion of the distal end of the drive arm 22 into the reversed motion. Engaging vanes 25 and 26 for transmitting a drive force of the cage door structure to the platform door structure are respectively coupled with the ends of the drive arm 22 and the follower arm 23, through links 27 and 28. Each of the engaging vanes 25 and 26 includes a fixed plate 56 and a movable plate 57. These plates are spaced at a distance, which is shorter than a distance between a fixed roller 52A and a movable roller 52B of a platform drive door 36 and is shorter than a distance between a first vibration damping roller 54A and a second vibration damping roller 54B of a platform follower door 37. If required, the distance between these plates is enlarged. Reference numerals 29 and 30 designate poles for supporting the cross beam, which are respectively fastened to the side faces of the cross beam 12. Door shoes 31 and 32 are fastened to the bottoms of the cage sliding doors 3 and 4, and slidable on a threshold 33 fastened to the cage 1. Reference numeral 100 represents an elevator path, and numeral 101 indicates an elevator platform.

The construction of the platform door structure will be described with reference to FIGS. 12 and 14. In the figure, reference numeral 34 designates a wall of the elevator path

100; numeral 35, an entranceway formed in the wall 34; 36, the platform drive door driven through the movement of the cage sliding door for opening and closing; and 37, the platform follower door 37 driven through the movement of the platform drive door 36 for opening and closing. The platform drive door 36 and the platform follower door 37 form sliding doors for opening and closing the entranceway 35. Reference numerals 38 and 39 indicate hanger plates from which the platform drive door 36 and the platform follower door 37 are suspended; 40 and 41, hanger rollers of which the shafts are supported by the hanger plates 38 and 39; numeral 42, a rail; and 43 and 44, rollers being in contact with the lower side of the rail 9 in order to prevent the hanger plates 38 and 39 from slipping off the rail 9. Numeral 45 designates a hanger case fastened to the wall 34 of the elevator path by means of fittings 46. The platform follower door 37 is interlocked with the platform drive door 36 by a rope 47. Numerals 48 and 49 designate rope pulleys. Numerals 50 and 51 designate interlocks, which are fastened to the hanger case 45 and the hanger plate 38. These interlocks are placed to a locked state when the cage 1 is off the floor. The movable roller 52B comes in engagement with the fixed plate 56 when the cage sliding door 4 is moved for opening, thereby to unlock the interlock 51 by a coupling bar 53. The fixed roller 52A and the movable roller 52B are fastened to the platform drive door 36, through a mounting plate 72, and the first vibration damping roller 54A and the second vibration damping roller 54B are fastened to the platform follower door 37 through a mounting plate 75. Numeral 55 designates a weight for pulling down the platform drive door 36 and the platform follower door 37 in the door closing direction.

The construction of a portion A in FIG. 13 will be described with reference to FIG. 15. In the figure, the engaging vanes 25 and 26 each include the fixed plate 56 and the movable plate 57. A distance between the two plates vary depending on an angle of the link 27 (28), by a mechanism including a roller 58 attached to the tip of the link 27 (28) and a cam 59 fastened to the movable plate 57. Reference numeral 60 designates a spring constantly urging the two plates 56 and 57 in a closing direction.

The engagement of the cage door structure with the platform door structure will be described with reference to FIGS. 16 and 17. FIG. 16 is a view showing a full close state of the door structure, and FIG. 17 is a view showing a state of the door structure when it is being opened and a state of the door structure being opened to the full width. In the full close state, the movable plate 57 is in a closed state, since the roller 58 is at a position P1 on the cam 59 shown in FIG. 15. Accordingly, a distance between the fixed plate 56 of the engaging vane 25 provided on the cage sliding door 3 and the movable plate 57 is kept to be narrower than the distance between the fixed roller 52A and the movable roller 52B of the platform drive door 36. A distance between the fixed plate 56 of the engaging vane 26 provided on the cage sliding door 4 and the movable plate 57 is also kept to be narrower than the distance between the first vibration damping roller 54A and the second vibration damping roller 54B of the platform follower door 37. Thus, these plates are spaced by a certain distance. With the movement of the sliding doors 3 and 4 in the opening direction, the roller 58 shown in FIG. 15 moves to the position P2 on the cam 59, so that the distance between the two plates 56 and 57 becomes large, and the fixed plate 56 and the movable plate 57 of the engaging vane 25 are brought into contact with the movable roller 52B and the fixed roller 52A provided on the platform drive door 36. A distance between the first vibration damping roller 54A and the second vibration damping roller 54B, which are attached to the platform follower door 37, is set to be slightly larger than the largest distance between the fixed plate 56 and the movable plate 57 of the engaging vane 26 attached to the cage sliding door 4. Slight gaps between the two vanes of the engaging vane 26 and the first vibration damping roller 54A and the second vibration damping roller 54B are secured.

The operation of the door structure thus constructed will be described. A drive force generated by the door motor 14 is transmitted to the sliding doors 3 and 4 by way of the belt 15, the chain 16, and the 4-string link 17. With the movement of the sliding doors 3 and 4, angles of the links 27 and 28 vary, so that the distance between the fixed plate 56 and the movable plate 57 of each of the engaging vanes 25 and 26 becomes large. The engaging vanes 25 and 26 come in contact with the movable roller 52B of the platform drive door 36, to transfer a drive force of the cage sliding door 3 to the platform drive door 36. The engaging vane 25 is brought into contact with the fixed roller 52A and the movable roller 52B as shown in FIG. 17, thereby to unlock the platform drive door 36. In the platform follower door 37, the engaging vane 26 engage the first vibration damping roller 54A and the second vibration damping roller 54B, with small gaps therebetween. The platform follower door 37 receives a drive force transmitted by the rope 47, thereby to open and close. The distance between the first vibration damping roller 54A and the second vibration damping roller 54B and the gaps between these rollers and the engaging vane 26 are adjusted so as to absorb a difference between the opening/closing operations of the cage sliding door 4 and the platform follower door 37. The engaging vane 26, and the first and second vibration damping rollers 54A and 54B are provided in order to damp a vibration of the platform follower door 37 when the door is operated at a high speed or when the sliding doors 3 and 4 are moved reversely. When an opening/closing load abruptly changes, the rope 47 is extended and a vibration takes place. When the rope 47 is extended to exceed a gap between the engaging vane 26 and the distance between the first vibration damping roller 54A and the second vibration damping roller 54B, or when the platform follower door 37 moves relative to the cage sliding door 4 a distance in excess of the gap, the engaging vane 26 comes in contact with the first vibration damping roller 54A or the second vibration damping roller 54B, thereby damping the vibration of the platform follower door 37.

In the elevator door structure thus constructed, an error is caused during the opening/closing process of the cage sliding doors 3 and 4 driven by the 4-string link mechanism, the platform drive door 36 driven by the cage sliding door 3, and the platform follower door 37 driven by the interlocking mechanism through the platform drive door 36 and the rope 47. To remove the error, the positional relationship of the engaging vane 26 with respect to the distance between the first and second vibration damping rollers 54A and 54B must be adjusted over the entire range of the opening/closing run of the sliding doors 3 and 4. Much time is consumed for this adjustment. Additionally, it is noted that the cage door structure includes the 4-string mechanism. When a difference between the strokes of the sliding doors 3 and 4 is large, the opening/closing process error is also large. In this case, it is difficult to absorb the opening/closing process difference between the cage sliding door 4 and the platform follower door 37, and to adjust the gap so as not to deteriorate the vibration damping effect.

SUMMARY OF THE INVENTION

The present invention has been made to solve the problems as mentioned above, and has an object to provide a door structure for an elevator which allows a service engineer to easily adjust a gap between the engaging vane and the distance between the first and second vibration damping rollers, and an adjusting method suitable for the door structure.

According to the present invention, there is provided a door structure for an elevator comprising: a first cage sliding door provided at the entrance way; a second cage sliding door provided on the cage and coupled with the first cage sliding door through an interlocking means, the second cage sliding door being movable in the opposite direction with respect to the first cage sliding door; a platform drive door provided at the entranceway of a platform of the elevator, the platform drive door being driven by the first cage sliding door; a platform follower door provided on the platform and coupled with the platform drive door through a platform interlocking means, the platform follower door moving facing the second cage sliding door; a vibration damping engaging mechanism, provided on the second cage sliding door in opposition to the platform follower door, being movable in the direction orthogonal to the lifting direction of the cage, in connection with the opening/closing movement of the second cage sliding door; and vibration damping members, provided on the platform follower door in opposition to the second cage sliding door, being located at such positions as to form gaps on both sides of the vibration damping engaging mechanism, wherein, through the operation of the vibration damping engaging mechanism, when the second cage sliding door is present near to a full open position or a full close position, the gaps are larger than those when the second cage sliding door is present near to the center of the path along which the second cage sliding door runs for opening and closing.

The door structure of the invention further comprises a link mechanism operating depending on a variation of a position where it engages a cam as the result from the opening/closing movement of the second cage sliding door. With provision of the link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing.

The door structure of the invention further comprises a cam turning depending on the opening/closing movement of the second cage sliding door, and a link mechanism operating depending on a variation of a position where it engages a cam as the result from the opening/closing movement of the second cage sliding door, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing.

The door structure of the invention further comprises a cam fastened to the second cage sliding door, and a link mechanism operating depending on a variation of a position where it engages the cam as the result from the opening/closing movement of the second cage sliding door, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing.

The door structure of the invention further comprises a vibration damping engaging mechanism with a link mechanism weight balanced such so as to operate constantly in such a direction as to increase the gap from it and the vibration damping members.

According to another aspect of the invention, there is provided a door structure for an elevator comprising: a first cage sliding door provided at the entrance way; a second cage sliding door provided on the cage and coupled with the first cage sliding door through an interlocking means, the second cage sliding door being movable in the opposite direction with respect to the first cage sliding door; a platform drive door provided at the entranceway of a platform of the elevator, the platform drive door being driven by the first cage sliding door; a platform follower door provided on the platform and coupled with the platform drive door through a platform interlocking means, the platform follower door moving facing the second cage sliding door; a vibration damping engaging mechanism, provided on the second cage sliding door in opposition to the platform follower door, being movable in the direction orthogonal to the lifting direction of the cage, in connection with the opening/closing movement of the second cage sliding door; and vibration damping members, provided on the platform follower door in opposition to the second cage sliding door, being located at such positions as to form gaps on both sides of the vibration damping engaging mechanism, wherein, through the operation of the vibration damping engaging mechanism, when the second cage sliding door runs in a low speed mode where the second cage sliding door is accelerated or decelerated, the gaps are larger than those when the second cage sliding door runs in a high speed mode.

According to an additional aspect of the invention, there is provided a method of adjusting a door structure for an elevator having a platform sliding door provided at the entranceway of a platform of an elevator, a cage sliding door provided at the entranceway of a cage, an engaging mechanism, provided on the cage sliding door in opposition to the platform sliding door, being movable in the direction orthogonal to the lifting direction of the cage, in connection with the opening/closing movement of the cage sliding door, a mounting plate movably mounted on the platform sliding door in opposition to the cage sliding door, and engaging members mounted on the mounting plate in a given engagement relationship of the engaging members and the engaging mechanism, wherein the cage of the elevator is set facing the platform, the platform sliding doors and the cage sliding doors are half opened, the mounting plate is slid, and adjustment is made so as to set up the given engagement relationship of the engaging members and the engaging mechanism.

In the door structure for an elevator according to the present invention, through the operation of the vibration damping engaging mechanism, when the second cage sliding door is present near to a full open position or a full close position, the gaps are larger than those when the second cage sliding door is present near to the center of the path along which the second cage sliding door runs for opening and closing. When the cage is running in a state that the cage sliding doors are in a full close state and when the second cage sliding doors are near to the full open position where its running speed is slow, the gaps are larger than those when the second cage sliding doors are near to the center of the path of the second cage sliding door where its running speed is high.

The door structure of the invention further comprises a link mechanism operating depending on a variation of a position where it engages a cam as the result from the opening/closing movement of the second cage sliding door. With provision of the link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. With this construction, through the operation of the link mechanism engaging the cam, when the cage is running in a state that the cage sliding doors are in a full close state and when the second cage sliding doors are near to the full open position where its running speed is slow, the gaps are larger than those when the second cage sliding doors are near to the center of the path of the second cage sliding door where its running speed is high.

The door structure of the invention further comprises a cam turning depending on the opening/closing movement of the second cage sliding door, and a link mechanism operating depending on a variation of a position where it engages a cam as the result from the opening/closing movement of the second cage sliding door. With provision of the cam and the link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. With this construction, through the operation of the link mechanism which operates engaging the turning cam, when the cage is running in a state that the cage sliding doors are in a full close state and when the second cage sliding doors are near to the full open position where its running speed is slow, the gaps are larger than those when the second cage sliding doors are near to the center of the path of the second cage sliding door where its running speed is high.

The door structure of the invention further comprises a cam fastened to the second cage sliding door, and a link mechanism operating depending on a variation of a position where it engages the cam as the result from the opening/closing movement of the second cage sliding door, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. With this construction, through the operation of the link mechanism which operates depending on a position where it engages the cam fastened to the cage sliding door, when the cage is running in a state that the cage sliding doors are in a full close state and when the second cage sliding doors are near to the full open position where its running speed is slow, the gaps are larger than those when the second cage sliding doors are near to the center of the path of the second cage sliding door where its running speed is high.

The door structure of the invention further comprises a vibration damping engaging mechanism with a link mechanism weight balanced such so as to operate constantly in such a direction as to increase the gap from it and the vibration damping members. With this construction, the large gaps between the vibration damping engaging mechanism and the vibration damping members are secured in the closed state.

In the door structure of the invention, through the operation of the vibration damping engaging mechanism, when the second cage sliding door runs in a low speed mode where the second cage sliding door is accelerated or decelerated, the gaps are larger than those when the second cage sliding door runs in a high speed mode.

According to the present invention, there is provided the method of adjusting a door structure for an elevator having a platform sliding door provided at the entranceway of a platform of an elevator, a cage sliding door provided at the entranceway of a cage, an engaging mechanism, provided on the cage sliding door in opposition to the platform sliding door, being movable in the direction orthogonal to the lifting direction of the cage, in connection with the opening/closing movement of the cage sliding door, a mounting plate movably mounted on the platform sliding door in opposition to the cage sliding door, and engaging members mounted on the mounting plate in a given engagement relationship of the engaging members and the engaging mechanism, wherein the cage of the elevator is set facing the platform, the platform sliding doors and the cage sliding doors are half opened, the mounting plate is slid, and adjustment is made so as to set up the given engagement relationship of the engaging members and the engaging mechanism. With such a construction, adjustment is possible in a state that the engaging members engage the engaging mechanism.

DETAILED DESCRIPTION OF THE PREFERRED EMBODIMENTS

Figure 1:
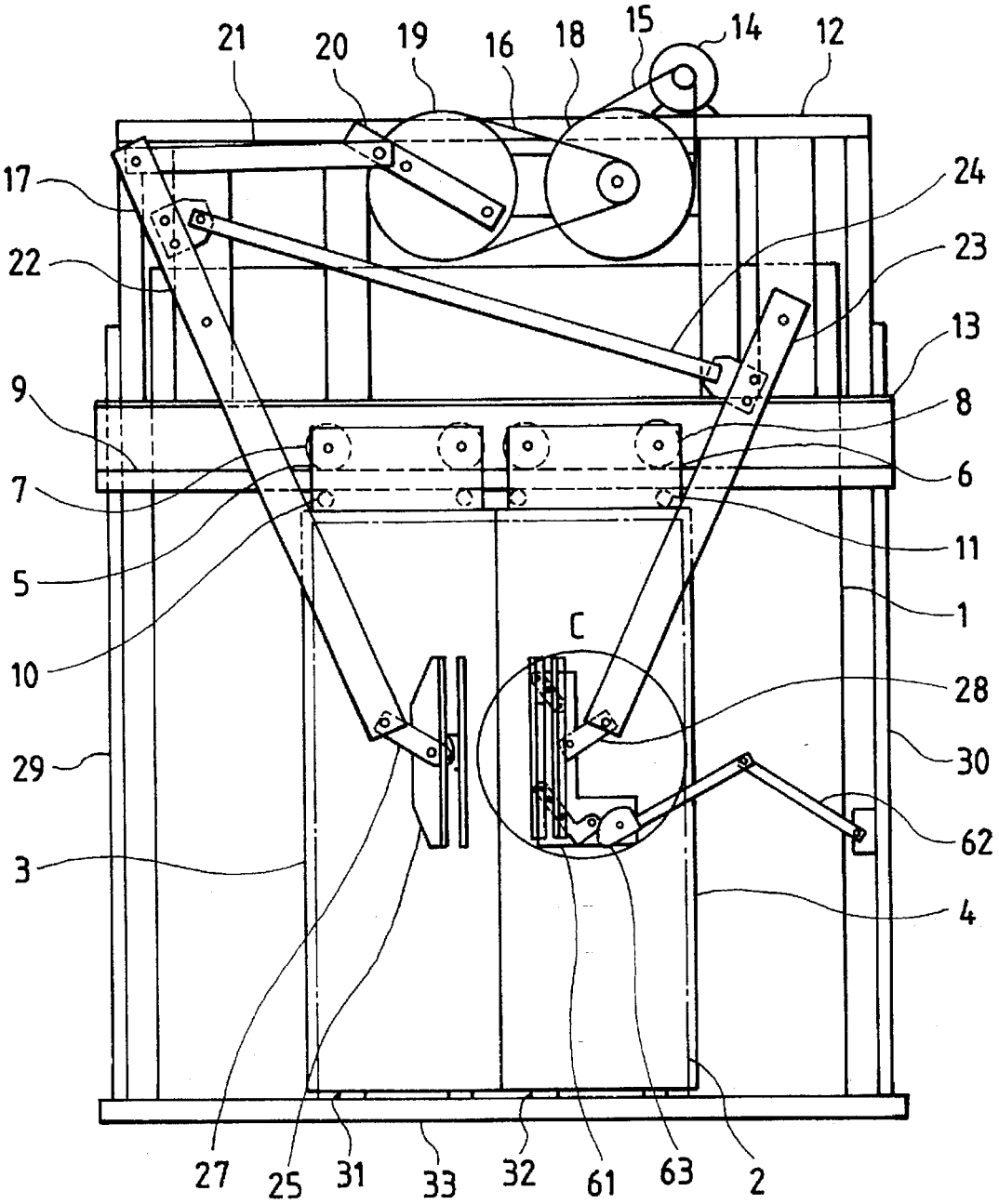
FIG. 1 is a front view showing a door structure for an elevator according to an embodiment of the present invention, as viewed from the platform of the elevator.
Figure 2:
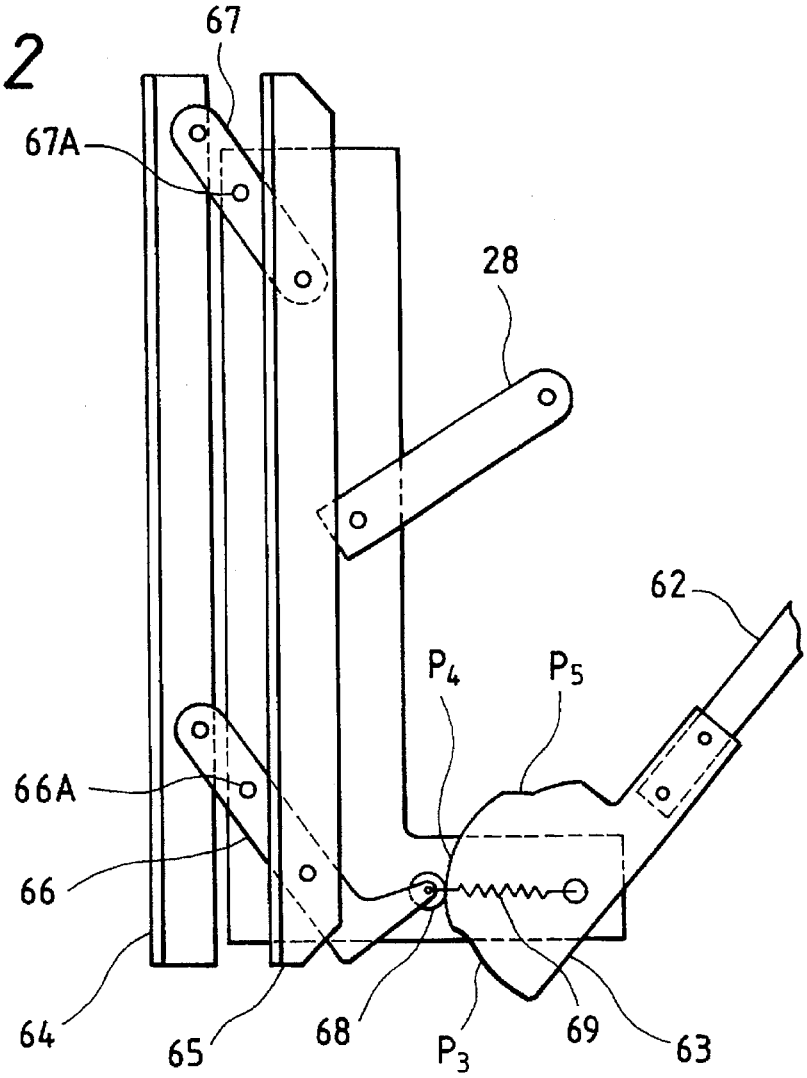
FIG. 2 is an enlarged view showing a portion C in FIG. 1.
Figure 13:
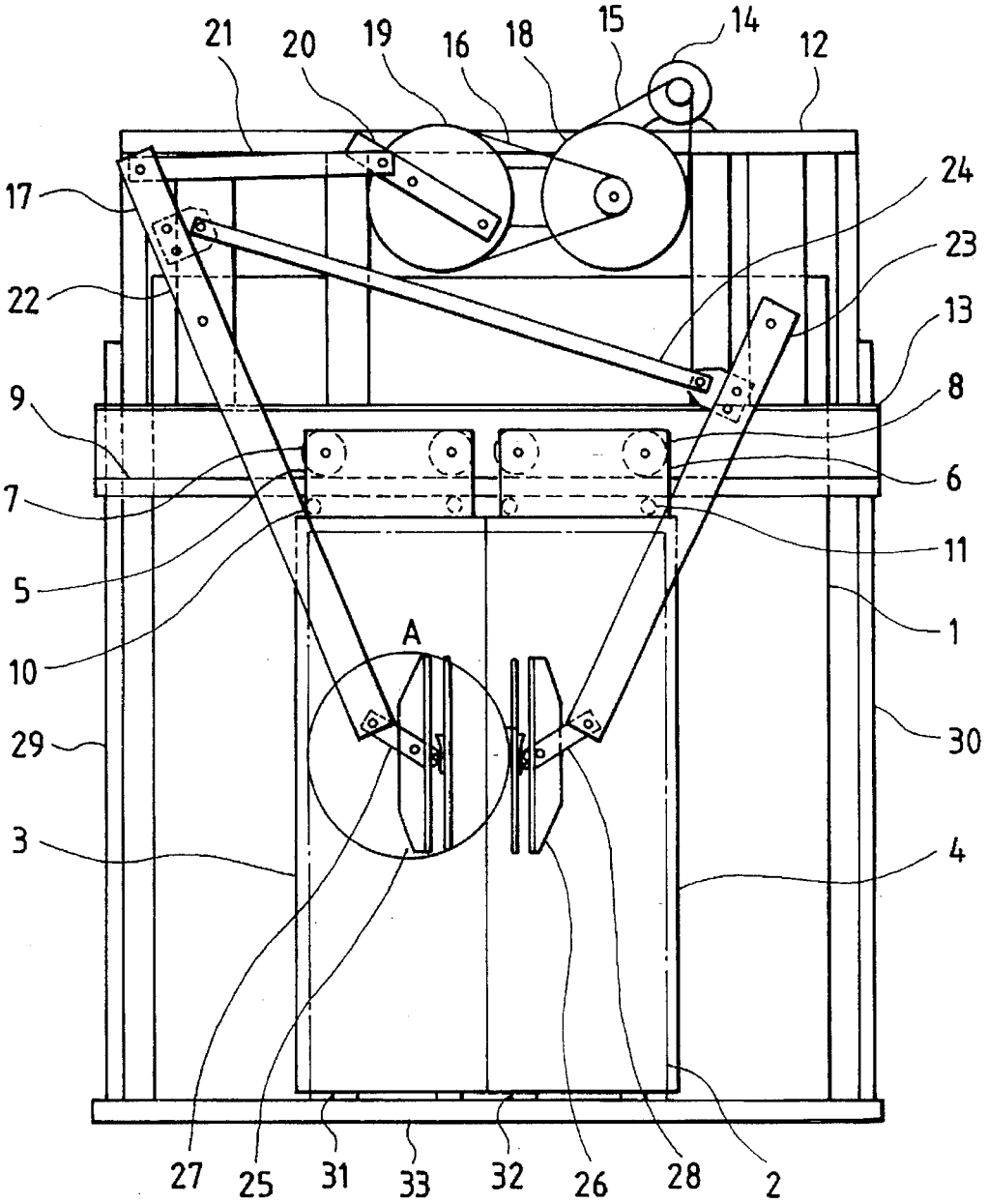
FIG. 13 is a front view showing a cage door structure in FIG. 12, as viewed from the platform.

A first embodiment of the present invention will be described with reference to the accompanying drawings. FIG. 1 is a front view showing a door structure for an elevator according to an embodiment of the present invention, the view being viewed from the platform of the elevator, and FIG. 2 is an enlarged view showing a portion C in FIG. 1. In the figures, like reference numerals are used for designating like or equivalent portions in FIG. 13. Hence, no further description of those portions will be given. In the figures, reference numeral 61 designates a movable engaging vane as a vibration damping engagement mechanism fastened to a cage sliding door 4; numeral 62, a link rotatably supported at the base end by a pole 30; and 63, a cam fastened to the distal end of the link 62. The cam turns when the link 62 is moved. The movable engaging vane 61 is provided with movable plates 64 and 65. These plates are movable for opening and closing with the aid of parallel links 66 and 67 that are turned about fulcrums 66A and 67A. Reference numeral 68 designates a roller provided at the distal end of the parallel link 66. The roller 68 changes a distance between the movable plates 64 and 65 with the turn of the cam 63. The parallel links 66 and 67 are balanced in weight so as to constantly move them in the closing direction. Further, the movable plates 64 and 65 are constantly urged in the closing direction by means of a spring 69.

The operation of the elevator door structure according to an embodiment of the present invention, which is illustrated in FIGS. 1 and 2, will be described with reference to FIGS. 3 through 5.

Figure 3:
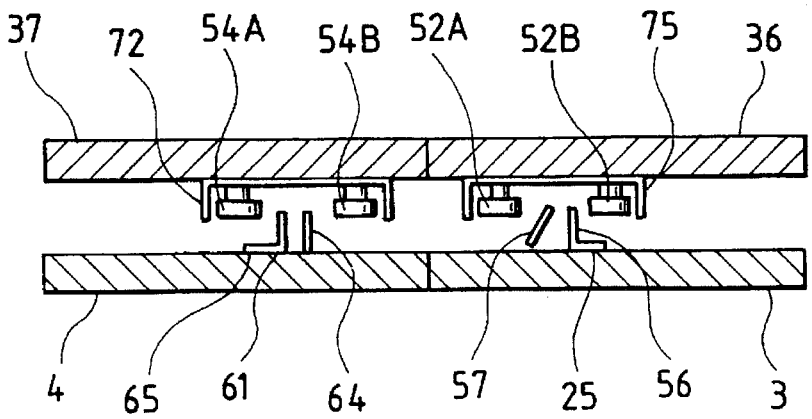
FIG. 3 is an explanatory diagram showing a structural state of the cage sliding doors, the platform drive and follower doors when the doors are closed in the elevator door structure according to the embodiment of the present invention.
Figure 4:
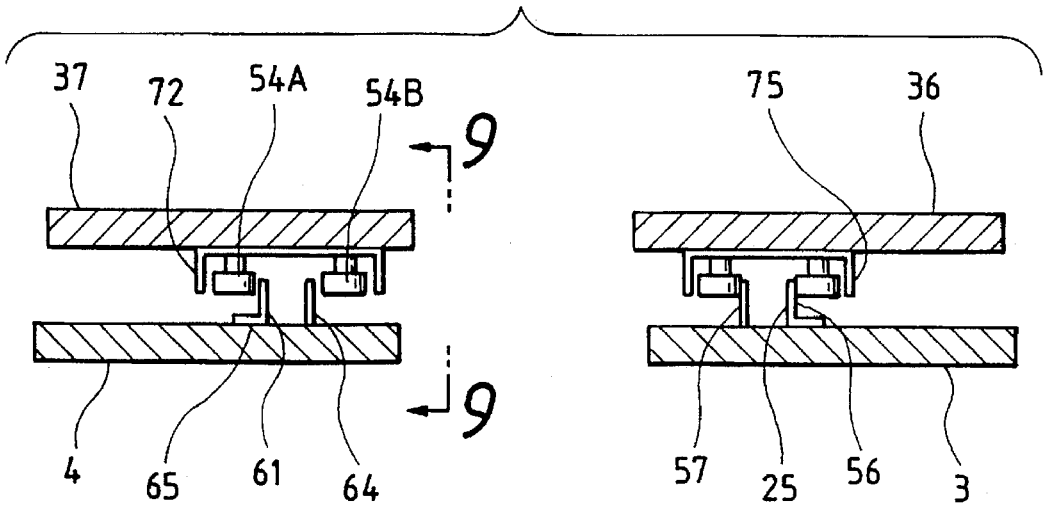
FIG. 4 is an explanatory diagram showing a structural state of the cage sliding doors, the platform drive and follower doors when the doors are being moved for opening in the elevator door structure.
Figure 5:
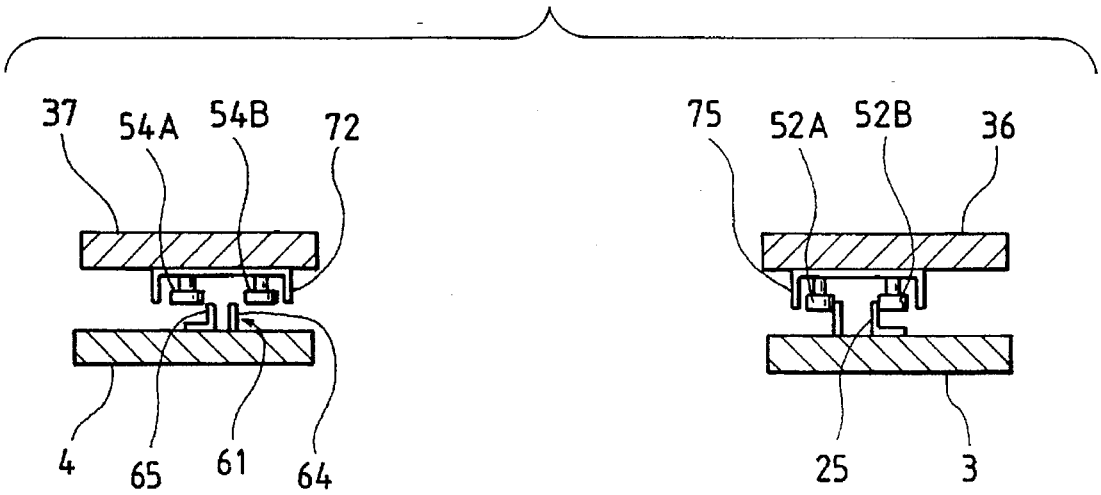
FIG. 5 is an explanatory diagram showing a structural state of the cage sliding doors, the platform drive and follower doors when the doors are in a full open state in the elevator door structure.
Figure 16:
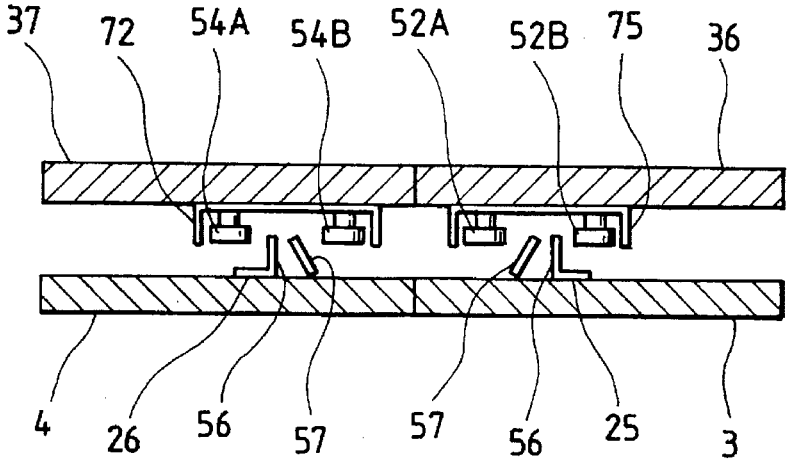
FIG. 16 is an enlarged views showing a portion B in FIG. 12, the illustration showing a structural state when the doors are in a closing state.
Figure 17:
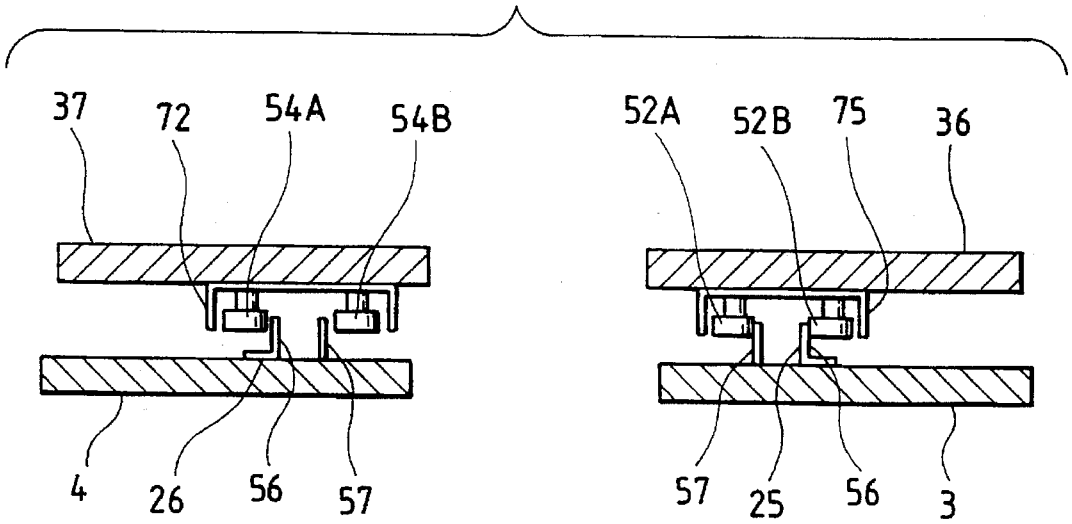
FIG. 17 is an enlarged views showing a portion B in FIG. 12, the illustration showing a structural state when the doors are in an opening state.

FIGS. 3 through 5 show engaging states of the sliding doors 3 and 4, the platform drive door 36, and the platform follower door 37 in the elevator door structure. Of those figures, FIG. 3 shows a state of those doors when the doors are closed in the elevator door structure. FIG. 4 shows a state of those doors when the doors are being moved for opening. FIG. 5 shows a state of those doors when the doors are in a full open state. In those figures, like reference numerals designate like or equivalent portions in FIG. 16, and no further description thereof will be given. When the sliding doors 3 and 4 are in a full close state, the roller 68 (FIG. 2) comes in contact with the cam 63 at a point P3. The two movable plates 64 and 65 are in a closed state. Gaps between the movable engaging vane 61 and the first and second vibration damping rollers 54A and 54B is large as shown in FIG. 3. During the opening movement of the sliding doors 3 and 4, the roller 68 (FIG. 2) moves to a point P4 on the cam 63 where the two movable plates 64 and 65 are in a full open state. The gaps between the movable engaging vane 61 and the first and second vibration damping rollers 54A and 54B becomes small as shown in FIG. 4. In the full open state of the sliding doors 3 and 4, the roller 68 (FIG. 2) moves to a point P5 on the cam 63 where the movable plates 64 and 65 start to close. The gaps between the movable engaging vane 61 and the first and second vibration damping rollers 54A and 54B becomes large again, as shown in FIG. 5.

During the course of the opening movement of the sliding doors 3 and 4 at high speed, the gaps between the movable engaging vane 61 and the first and second vibration damping rollers 54A and 54B becomes small. With a rapid reverse motion of the door in the middle of the opening stroke of the cage sliding door 4 where its running speed is high, and a large relative motion of the platform follower door 37 to the cage sliding door 4 which is caused by an extension of the rope 47 which ensues from the rapid reverse motion, the movable engaging vane 61 comes in contact with the first and second vibration damping rollers 54A and 54B. As a result, a sufficient vibration damping effect is secured for the platform follower door 37. In the vicinity of the full open state where the sliding door runs at low speed, the gaps between the movable engaging vane 61 and the first and second vibration damping rollers 54A and 54B becomes large, so that the adjustment can be made in a broader range.

As described above, both the movable plates 64 and 65 constituting the movable engaging vane 61 are operated by the parallel links 66 and 67. With this structure, the distance between the movable engaging vane 61 and each of the first and second vibration damping rollers 54A and 54B changes depending on the position of the cage sliding door 4 when it is moved for opening and closing. It is only needed that the gap between the movable engaging vane 61 and each of the first and second vibration damping rollers 54A and 54B is adjusted mainly at positions where the running speed of the cage sliding door 4 is high, viz., in the middle of the opening/closing stroke of the cage sliding door where the structural state shown in FIG. 4 is set up. Therefore, the adjustment work is very easy. Additionally, the link balance and the urging force of the spring 69 act in such a direction as to close the two movable plates 64 and 65. Accordingly, the movable plates 64 and 65 have surely been closed when the cage 1 goes up and down, thereby preventing the first vibration damping roller 54A from being brought into contact with the second vibration damping roller 54B.

Another embodiment of the present invention will be described.

Figure 6:
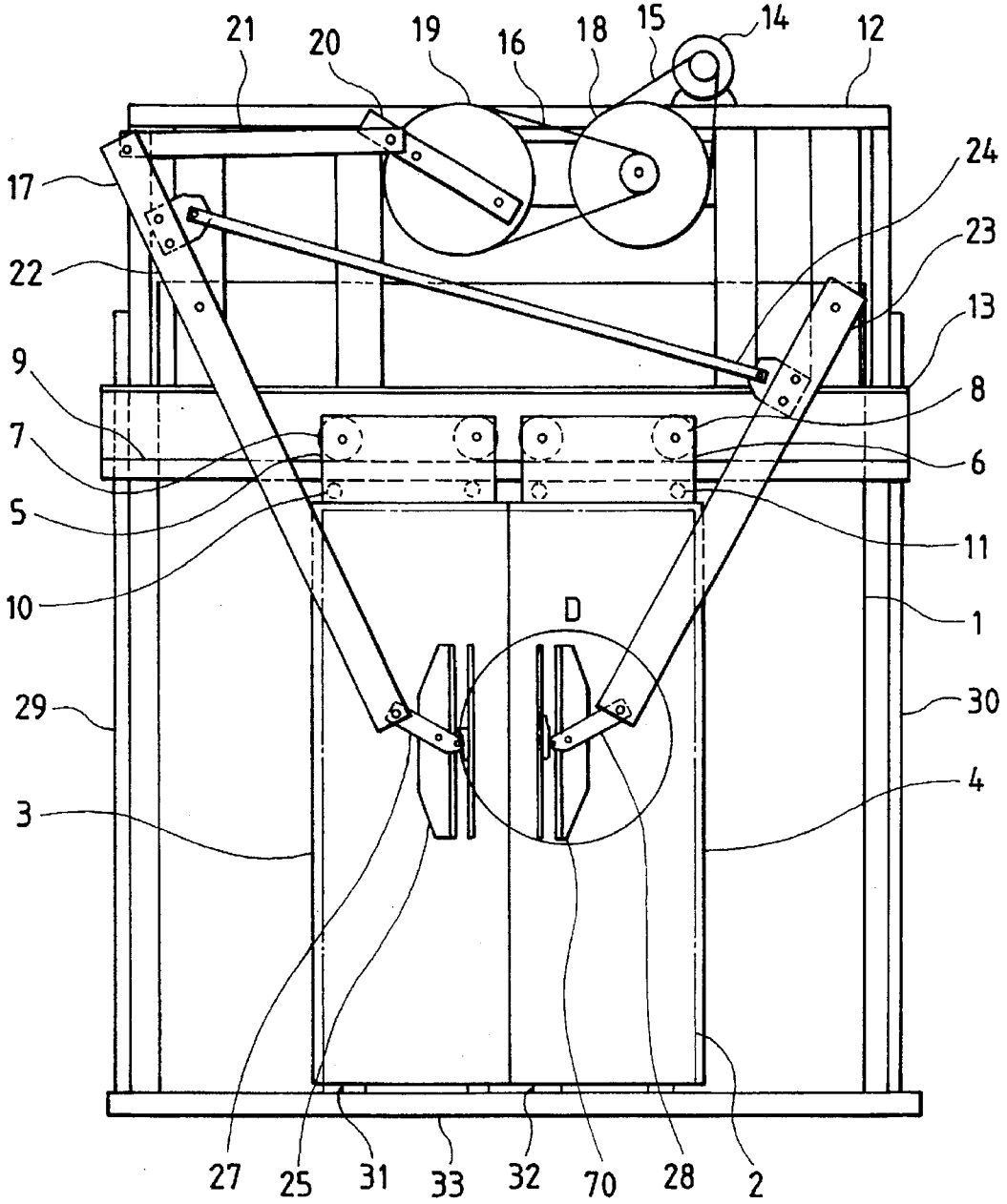
FIG. 6 is a front view showing a door structure for an elevator with an engaging vane according to another embodiment of the present invention.
Figure 7A:
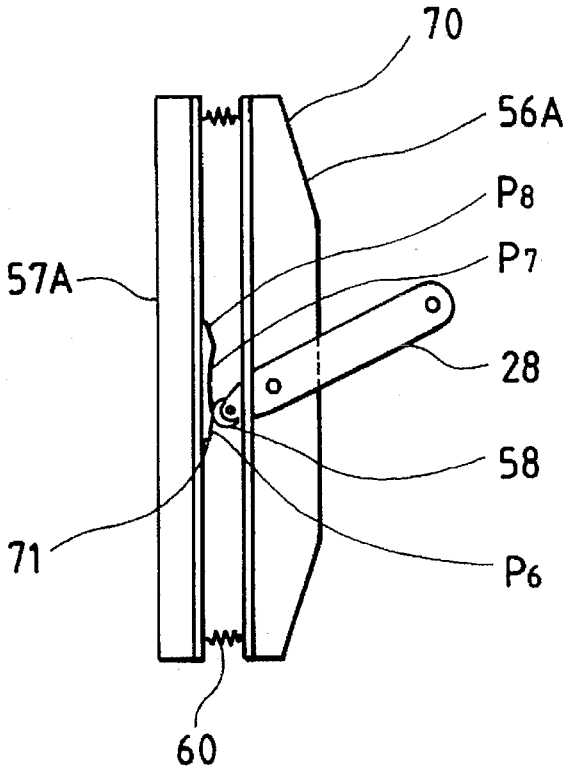
FIG. 7A is an enlarged view showing a portion D in FIG. 6.

FIG. 6 is a front view showing an elevator door structure with a vibration damping engaging mechanism according to another embodiment of the present invention, and FIG. 7A is an enlarged view showing a portion D in FIG. 6. In the figure, like reference numerals designate like or equivalent portions in FIG. 1, and description of them is omitted. In FIG. 7A, reference numeral 70 designates an engaging vane with a fixed plate 56A and a movable plate 57A, which constitute a vibration damping engaging mechanism. Reference numeral 71 indicates a cam for changing a distance between the fixed plate 56A and the movable plate 57A. The cam 71 is designed to decrease the distance when a rotation angle of the link 28 becomes large. The fulcrum positions of the drive arm 22 and the follower arm 23 are selected such that a turn angle of the link 28 is constantly oriented in one direction based on the position of the cage sliding door 4. That is to say, a link mechanism made up of the follower arm 23 and the link 28 is so arranged that the link 28 rotates constantly clockwise in FIG. 6 during when the door 4 moves in a direction from its fully closed position to its fully opened position, and constantly counterclockwise during when the door 4 moves in an opposite direction, i.e. a direction from its fully opened position to its fully closed position. Thus, the positions of the roller 58 of the link 28 on the cam 71 can surely be determined in correspondence with the positions of the door 4. A link mechanism made up of the drive arm 22 and the link 22 is similarly arranged in this embodiment.

Figure 7B:
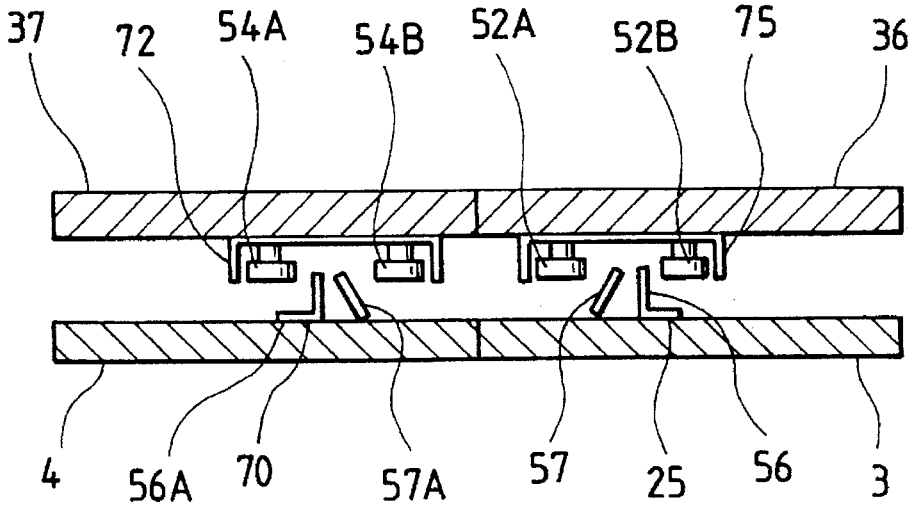
FIG. 7B is an explanatory diagram showing a structural state of the cage sliding doors, the platform drive and follower doors when the doors are closed in the elevator door structure according to the embodiment shown in FIG. 6.
Figure 7C:
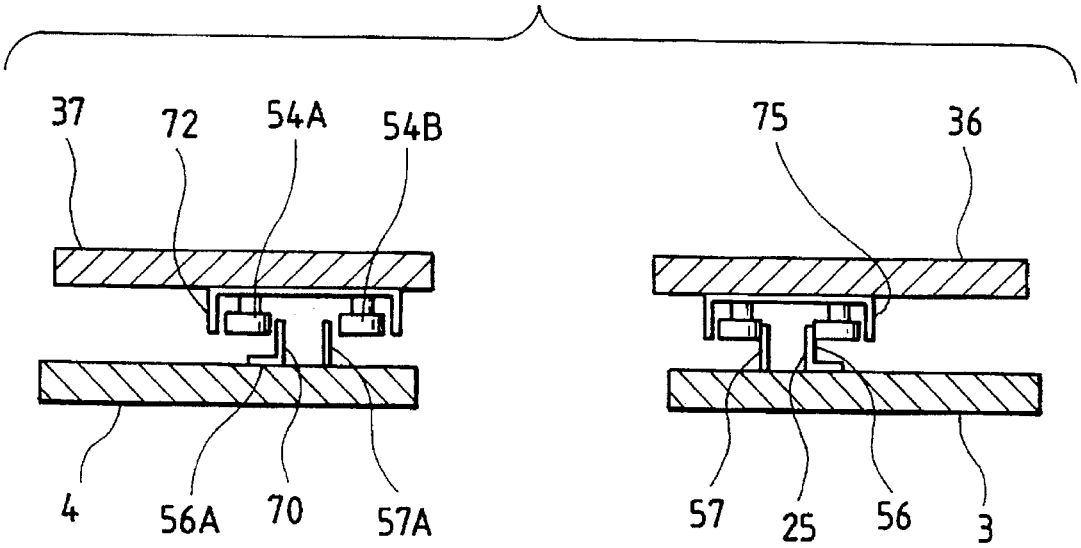
FIG. 7C is an explanatory diagram showing a structural state of the cage sliding doors, the platform drive and follower doors when the doors are being moved for opening in the elevator door structure according to the embodiment shown in FIG. 6.
Figure 7D:
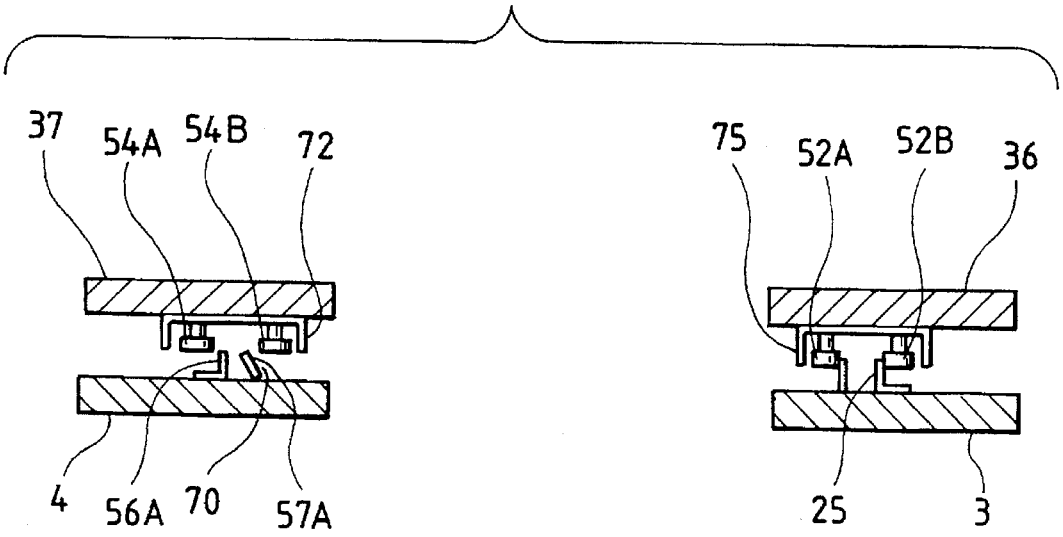
FIG. 7D is an explanatory diagram showing a structural state of the cage sliding doors, the platform drive and follower doors when the doors are in a full open state in the elevator door structure according to the embodiment shown in FIG. 6.

The operation of the second embodiment of the present invention will be described with reference to FIGS. 7B through 7D. When the sliding doors 3 and 4 are in a full close state, the roller 58 comes contact with a point P6 on the cam 71, and the distance between the fixed plate 56A and the movable plate 57A is narrow. Therefore, a large gap between the movable plate 57A of the engaging vane 70 and the second vibration damping roller 54B as a vibration damping means is secured as shown in FIG. 7B. In the midway of the opening or closing process of the doors 3 and 4, the roller 58 shown in FIG. 7A comes in contact with a point P7 on the cam 71, so that the fixed plate 56A and the movable plate 57A are in a full open state, and the gap between the movable plate 57A of the engaging vane 70 and the second vibration damping roller 54B becomes small. When the sliding doors 3 and 4 are in a full open state, the roller 58 (FIG. 7) comes in contact with a point P8 on the cam 71. The movable plate 57A of the engaging vane 70 closes again, so that the gap between the movable plate 57A of the engaging vane 70 and the second vibration damping roller 54B becomes large again, as shown in FIG. 7D.

Figure 8:
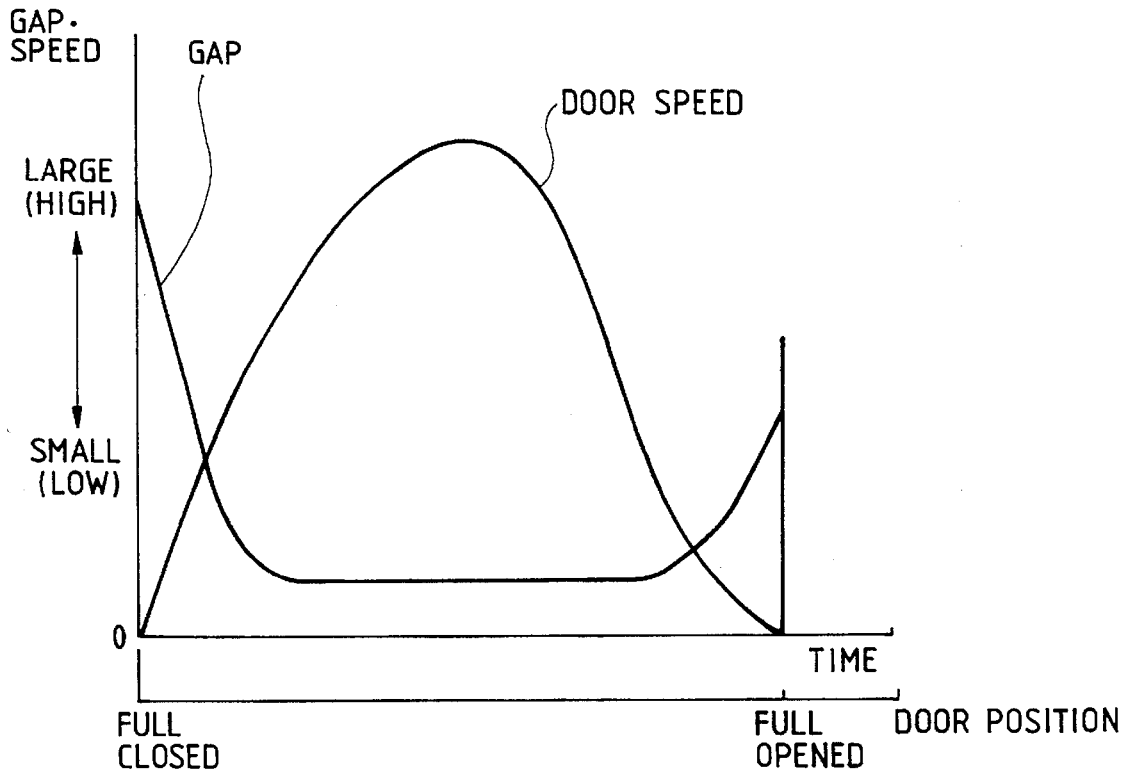
FIG. 8 is an explanatory diagram for explaining variations of a speed of the cage sliding door and gaps between a vibration damping engaging mechanism and vibration damping members in the elevator door structure according to the embodiment of the present invention.

The relationship among an opening/closing position and an opening/closing speed of the sliding doors 3 and 4, and the gaps between the vibration damping engaging mechanism and the vibration damping members will be described with reference FIG. 8. In a graph shown in FIG. 8, the abscissa represents a time elapse after the cage sliding door 4 starts to open and a position of the opening/closing door. The ordinate represents, in this embodiment, an opening/closing speed of the cage sliding door 4 and a gap between the movable plate 57A of the engaging vane 70 as the vibration damping engaging mechanism and the second vibration damping roller 54B as the vibration damping member. For the first embodiment shown in FIGS. 1 to 5, the ordinate may be considered to represent the sum of the gaps between the movable plate 65 and the first vibration damping roller 54A and between the movable plate 64 and the second vibration damping roller 54B. As shown in FIG. 8, the sliding doors 3 and 4 gradually increase their speed after these doors start to open, and decreases the speed as they approach to the full open state. Accordingly, the gaps between the engaging vane 70 and the vibration damping member in the middle of the opening/closing stroke where the running speed of the cage sliding door 4 is high, is made small. With a rapid reverse motion of the door and a large relative motion of the platform follower door 37 to the cage sliding door 4 which is caused by an extension of the rope 47 (FIG. 14) which ensues from the rapid reverse motion, the engaging vane 70 (or the movable engaging vane 61) comes in contact with the first and second vibration damping rollers 54A and 54B. As a result, a sufficient vibration damping effect is secured for the platform follower door 37. If the gaps between the engaging vane 70 (or the movable engaging vane 61) and the vibration damping members is adjusted mainly in the middle of the opening/closing stroke of the cage sliding door 4, there is no need of a strict adjustment of the gap in the full close position where the running speed of the cage sliding door 4 is low.

In the instance of FIG. 8, the gap between the vibration damping engaging mechanism and the vibration damping members when the doors are in the full open state, is smaller than that when the doors are in the full close state. If necessary, the relationship between the gaps in the full close state and in the full open state may be set as desired, by changing the configurations of the cam 63 shown in FIG. 2 or the cam 71 shown in FIG. 7A.

Figure 9:
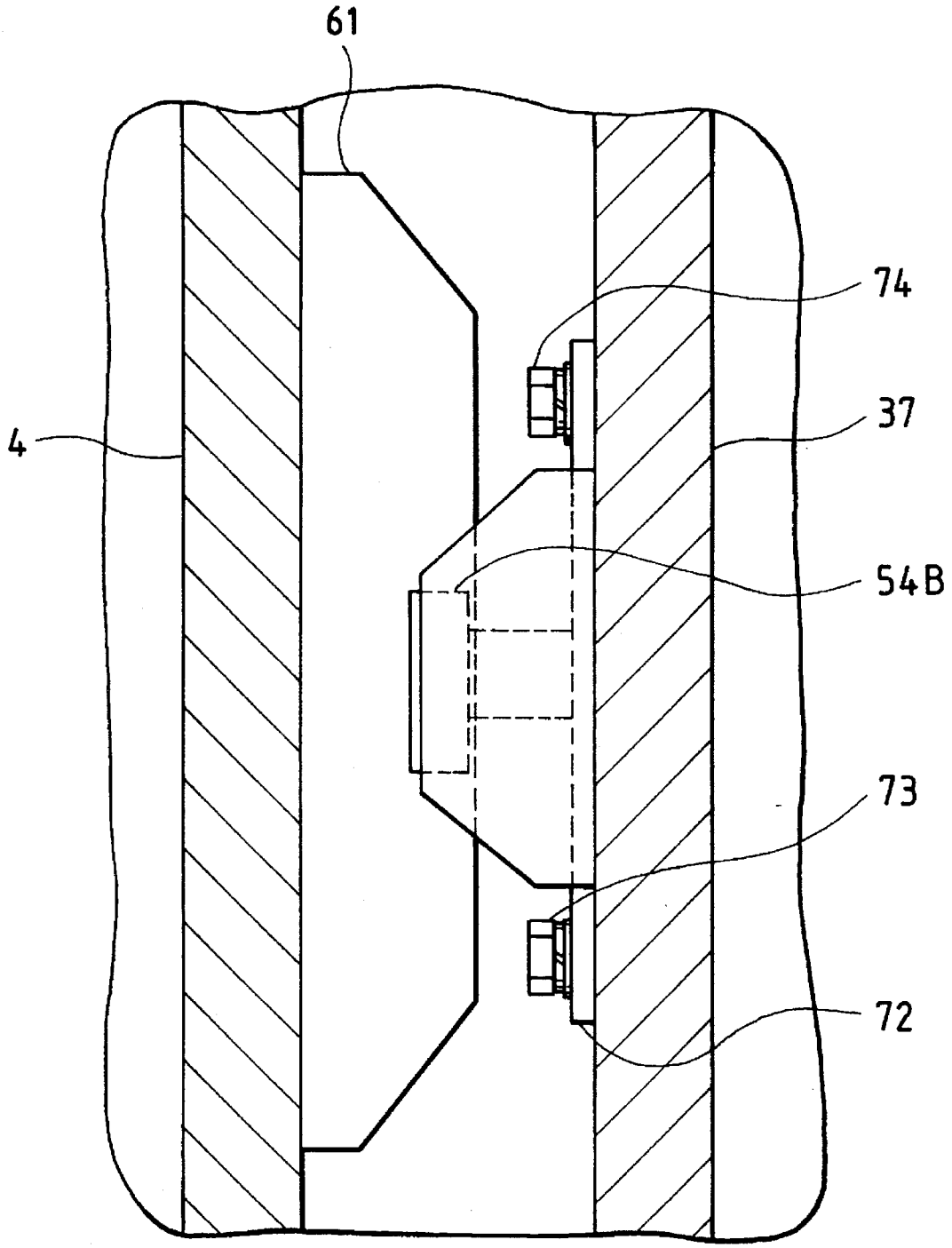
FIG. 9 is a cross sectional view taken on line 9—9 in FIG. 4.
Figure 10:
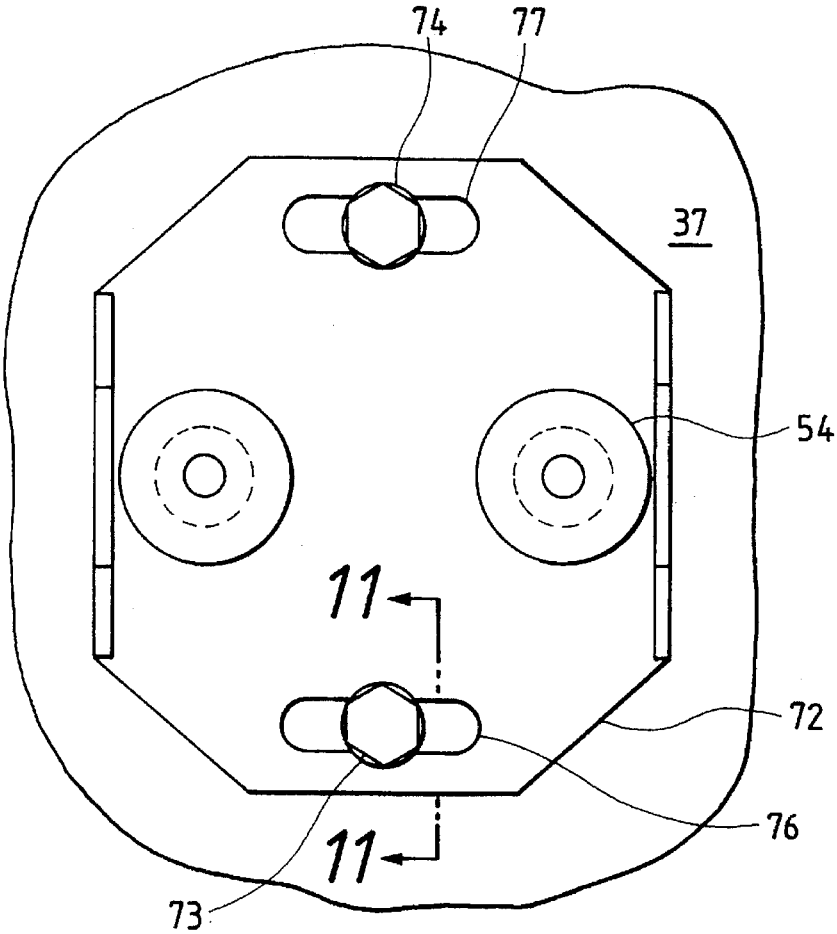
FIG. 10 is a front view showing a mounting plate shown in FIG. 4 when viewed from an elevator path.
Figure 11:
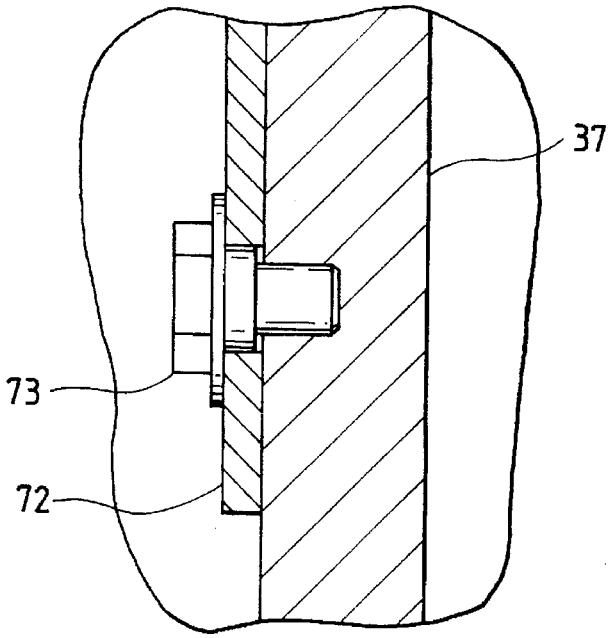
FIG. 11 is a cross sectional view taken on line 11—11 in FIG. 10.

A method of adjusting an elevator door structure constructed in accordance with the first embodiment of the present invention will be described. FIG. 9 is a cross sectional view taken on line 9—9 in FIG. 4, FIG. 10 is a front view showing a mounting plate shown in FIG. 4 when viewed from an elevator path, and FIG. 11 is a cross sectional view taken on line 11—11 in FIG. 10. In the figure, like reference numerals designate like or equivalent portions in FIG. 4, and hence no further description of them will be given. In the figure, reference numeral 72 designates a mounting plate for rotatably supporting the first and second vibration damping rollers 54A and 54B; and 73 and 74, fixing bolts for fastening the mounting plate 72 to the platform follower door 37. The fixing bolts 73 and 74 are mounted at locations accessible through the gap between the cage sliding door 4 and the platform follower door 37. Bolt holes 76 and 77 through which fixing bolts 73 and 74 for the mounting plate 72 are formed as elongated holes and the fixing bolts 73 and 74 serve as stepped shafts as shown in FIG. 11, so that when the bolts are in a loosened state, the mounting plate 72 is easily slidable.

Figure 12:
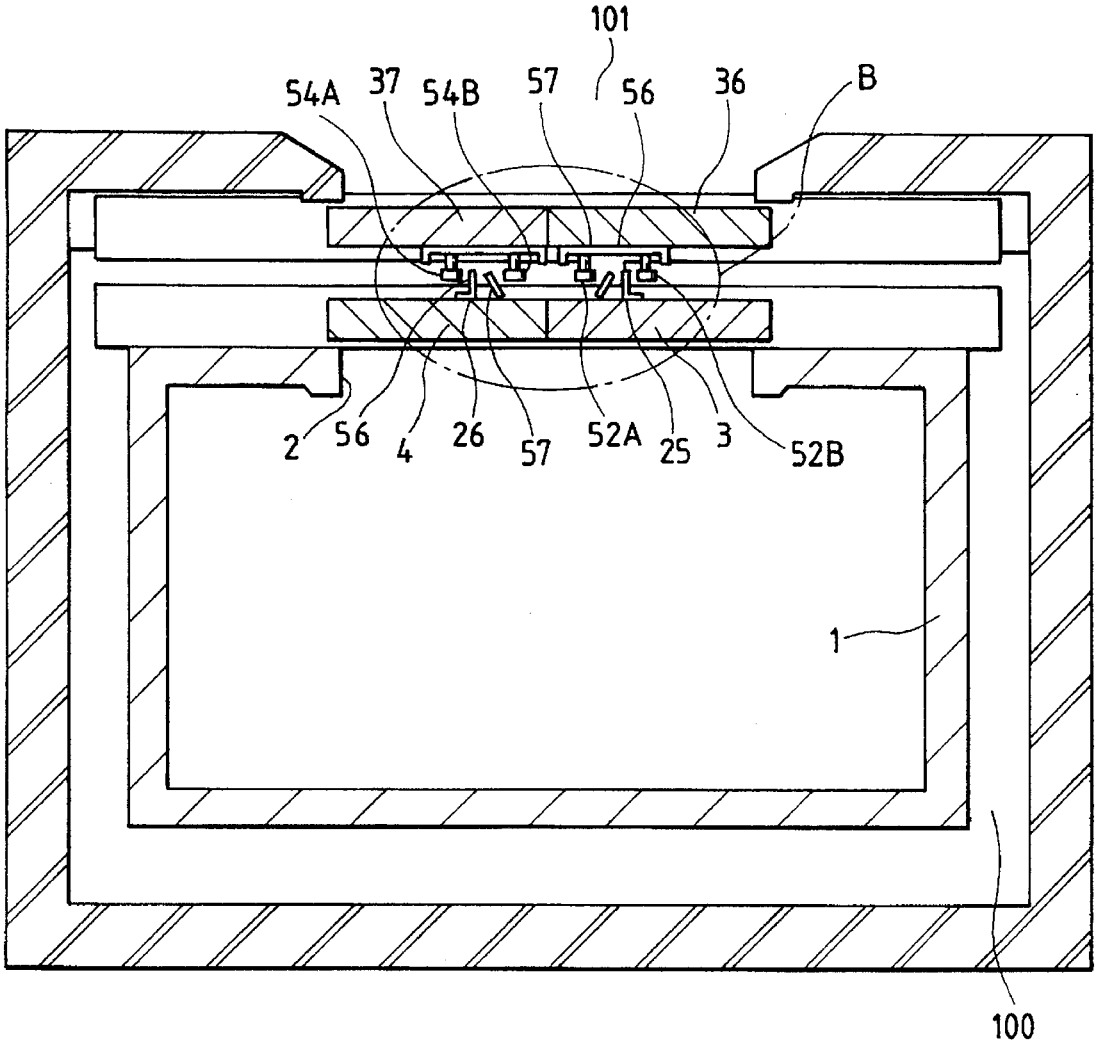
FIG. 12 is a cross sectional view showing a key portion of an elevator developed by one of the present inventors.

A method of adjusting the positional relationship between the movable engaging vane 61 and the first and second vibration damping rollers 54A and 54B will be described. The sliding doors 3 and 4 are each opened up to the center of the path along which the doors are moved for opening/closing, and the gap between the movable engaging vane and each of the first and second vibration damping rollers is measured by using a gauge, for example. Then, the fixing bolts 73 and 74 are loosened by using a suitable tool through the gap between the cage sliding door 4 and the platform follower door 37, and the mounting plate 72 is moved so that the measured distance on one side of the movable engaging vane is equal to the distance on the other side thereof. Thereafter, the fixing bolts 73 and 74 are fastened again. By this adjusting method, the distance adjustment at a required position on the path of the cage sliding door 4 may easily be made in a state that the movable engaging vane 61 engages the first and second vibration damping rollers 54A and 54B. In the distance adjustment of FIG. 12, the fixed and movable plates 56 and 57 provided on the cage sliding door 4 and the mounting plate 72 provided on the platform follower door 37 are individually positioned. A state of the engagement of the cage sliding door 4 with the platform follower door 37 is checked while moving those doors in the opening and closing directions. When the engagement of those doors are unsatisfactory, the cage 1 is stopped between the floors, and a service man, who gets on the cage 1, adjusts the position of the mounting plate 72. When the above-mentioned distance adjustment method of the invention is used, the service man stops the cage 1 at the platform, checks the engagement of the movable engaging vane 61 with the first and second vibration damping rollers 54A and 54B, and slides the mounting plate 72, through the gap between the cage sliding door 4 and the platform follower door 37. Therefore, the adjustment work can be performed safely and efficiently.

Figure 14:
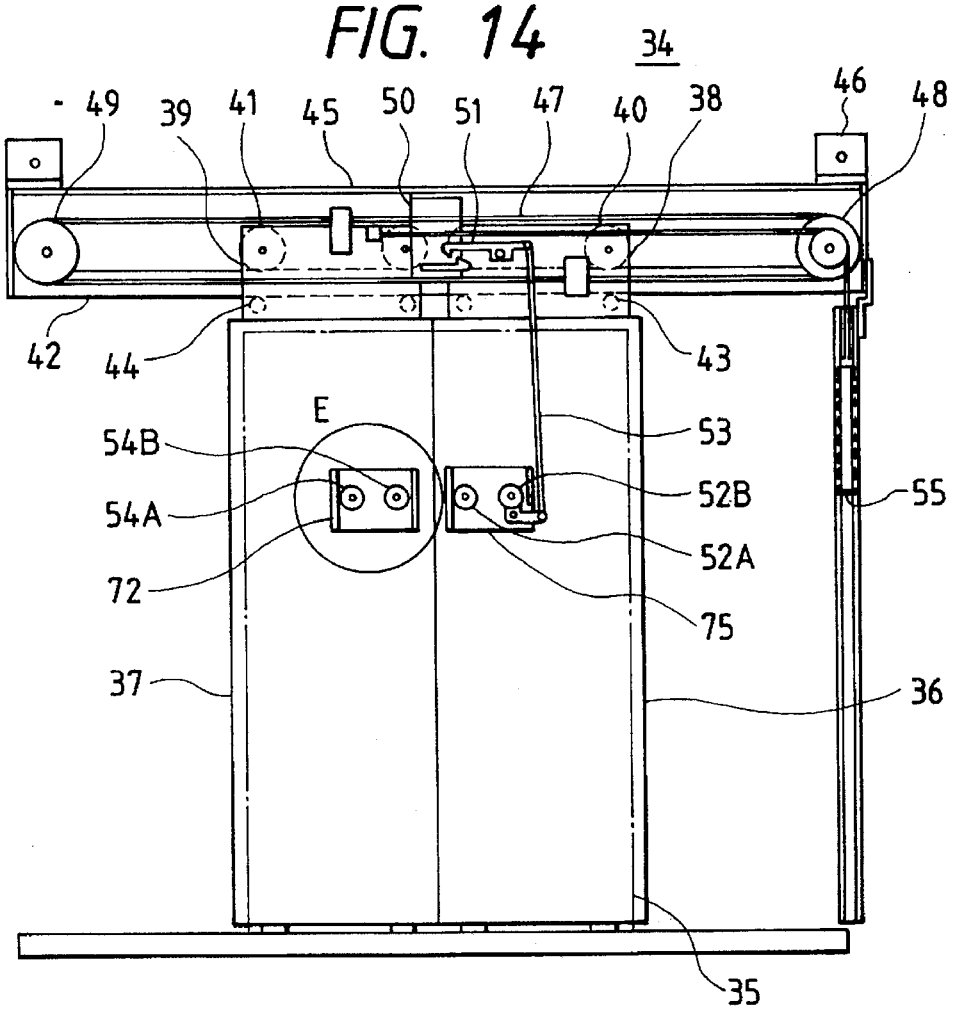
FIG. 14 is a front view showing a platform door structure in FIG. 12 when viewed from an elevator path.
Figure 15:
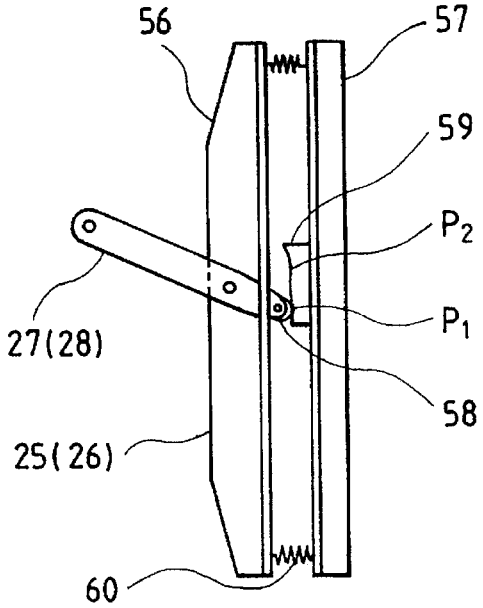
FIG. 15 is an enlarged view showing a portion A in FIG. 13.

While in the embodiments described above, the movable engaging vane 61 is used for the engaging mechanism, another type of the engaging mechanism may be used, if required. Additionally, in those embodiments, the mounting plate 72 with the first and second vibration killing rollers 54A and 54B attached thereto is used for the engaging member. The following alternative is allowed. The fixed roller 52A and the movable roller 52B as the engaging members shown in FIG. 14 are attached to the mounting plate 75, which slidably mounted. The adjustment of the positional relationship between the vibration damping member (the fixed movable rollers 52A and 52B) and the vibration damping engaging mechanism (the engaging vane 25) can be performed in a similar manner.

As seen from the foregoing description, in the present invention, through the operation of the vibration damping engaging mechanism, when the second cage sliding door is present near to a full open position or a full close position, the gaps are larger than those when the second cage sliding door is present near to the center of the path along which the second cage sliding door runs for opening and closing. Therefore, in the middle of the opening/closing stroke of the second cage sliding door where the running speed of this door is high, the gaps between the vibration damping engaging mechanism and the vibration damping members become narrow. Accordingly, with a rapid reverse motion of the door when the door runs at high speed and a large relative motion of the doors which is caused by an extension of the rope which ensues from the rapid reverse motion, the vibration damping engaging mechanism comes in contact with the vibration damping members. As a result, a sufficient vibration damping effect is secured for the platform follower door. On the other hand, in the vicinity of the full close and full open positions where the door runs at low speed little effecting the door vibration, the gaps between the vibration damping engaging mechanism and the vibration damping members can be adjusted in a wide range. Accordingly, the gap adjustment may be made such that the gaps are adjusted mainly in the middle of the opening/closing stroke of the sliding door where the gaps are small, while the gaps are adjusted roughly in the vicinity of the full close and open positions. Thus, the present invention succeeds in providing an easy-to-adjust elevator door structure.

The door structure of the invention further comprises a link mechanism operating depending on a variation of a position where it engages a cam as the result from the opening/closing movement of the second cage sliding door. With provision of the link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. Use of the link mechanism engaging the cam ensures a reliable operation of the vibration damping engaging mechanism. Therefore, in the middle of the opening/closing stroke of the second cage sliding door where the running speed of this door is high, the gaps between the vibration damping engaging mechanism and the vibration damping members become narrow. Accordingly, with a rapid reverse motion of the door when the door runs at high speed, and a large relative motion of the doors which is caused by an extension of the rope which ensues from the rapid reverse motion, the vibration damping engaging mechanism comes in contact with the vibration damping members. As a result, a sufficient vibration damping effect is secured for the platform follower door. On the other hand, in the vicinity of the full close and full open positions where the door runs at low speed little effecting the door vibration, the gaps between the vibration damping engaging mechanism and the vibration damping members can be adjusted in a wide range. Accordingly, it is only needed that the gaps are adjusted mainly in the middle of the opening/closing stroke of the sliding door where the gaps are small. Thus, the present invention succeeds in providing an easy-to-adjust elevator door structure.

The door structure of the invention further comprises a cam turning depending on the opening/closing movement of the second cage sliding door, and a link mechanism operating depending on a variation of a position where it engages a cam as the result from the opening/closing movement of the second cage sliding door. With provision of the cam and link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. Use of the link mechanism, which operates engaging the turning cam, ensures a reliable operation of the vibration damping engaging mechanism. Therefore, in the middle of the opening/closing stroke of the second cage sliding door where the running speed of this door is high, the gaps between the vibration damping engaging mechanism and the vibration damping members become narrow. Accordingly, with a rapid reverse motion of the door when the door runs at high speed, and a large relative motion of the doors which is caused by an extension of the rope which ensues from the rapid reverse motion, the vibration damping engaging mechanism comes in contact with the vibration damping members. As a result, a sufficient vibration damping effect is secured for the platform follower door. On the other hand, in the vicinity of the full close and full open positions where the door runs at low speed little effecting the door vibration, the gaps between the vibration damping engaging mechanism and the vibration damping members can be adjusted in a wide range. Accordingly, it is only needed that the gaps are adjusted mainly in the middle of the opening/closing stroke of the sliding door where the gaps are small. Thus, the present invention succeeds in providing an easy-to-adjust elevator door structure.

The door structure of the invention further comprises a cam fastened to the second cage sliding door, and a link mechanism operating depending on a variation of a position where it engages the cam as the result from the opening/closing movement of the second cage sliding door. With provision of the cam and link mechanism, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing. Use of the link mechanism, which operates depending on a position where it engages the cam fastened to the cage sliding door, ensures a reliable operation of the vibration damping engaging mechanism. Therefore, in the middle of the opening/closing stroke of the second cage sliding door where the running speed of this door is high, the gaps between the vibration damping engaging mechanism and the vibration damping members become narrow. Accordingly, with a rapid reverse motion of the door when the door runs at high speed, and a large relative motion of the doors which is caused by an extension of the rope which ensues from the rapid reverse motion, the vibration damping engaging mechanism comes in contact with the vibration damping members. As a result, a sufficient vibration damping effect is secured for the platform follower door. On the other hand, in the vicinity of the full close and full open positions where the door runs at low speed little effecting the door vibration, the gaps between the vibration damping engaging mechanism and the vibration damping members can be adjusted in a wide range. Accordingly, it is only needed that the gaps are adjusted mainly in the middle of the opening/closing stroke of the sliding door where the gaps are small. Thus, the present invention succeeds in providing an easy-to-adjust elevator door structure.

The door structure of the invention further comprises a vibration damping engaging mechanism with a link mechanism weight balanced such so as to operate constantly in such a direction as to increase the gap from it and the vibration damping members. With this construction, the large gaps between the vibration damping engaging mechanism and the vibration damping members are secured in the closed state. Thus, since the large gaps between the vibration damping engaging mechanism and the vibration damping members are secured in the closed state, when the cage goes up and down, the vibration damping engaging mechanism will never be brought into contact with the vibration damping members.

In the door structure of the invention, through the operation of the vibration damping engaging mechanism, when the second cage sliding door runs in a low speed mode where the second cage sliding door is accelerated or decelerated, the gaps are larger than those when the second cage sliding door runs in a high speed mode. Therefore, when the second cage sliding door runs at high speed, the gaps between the vibration damping engaging mechanism and the vibration damping members become narrow. Accordingly, with a rapid reverse motion of the door when the door runs at high speed, and a large relative motion of the doors which is caused by an extension of the rope which ensues from the rapid reverse motion, the vibration damping engaging mechanism comes in contact with the vibration damping members. As a result, a sufficient vibration damping effect is secured for the platform follower door. On the other hand, in the vicinity of the full close and full open positions where the door runs at low speed little effecting the door vibration, the gaps between the vibration damping engaging mechanism and the vibration damping members can be adjusted in a wide range. Accordingly, it is only needed that the gaps are adjusted mainly at the opening and closing positions of the second cage sliding door where the gaps are small and the door runs at high speed. Thus, the present invention succeeds in providing an easy-to-adjust elevator door structure.

According to the present invention, there is provided the method of adjusting a door structure for an elevator having a platform sliding door provided at the entranceway of a platform of an elevator, a cage sliding door provided at the entranceway of a cage, an engaging mechanism, provided on the cage sliding door in opposition to the platform sliding door, being movable in the direction orthogonal to the lifting direction of the cage, in connection with the opening/closing movement of the cage sliding door, a mounting plate movably mounted on the platform sliding door in opposition to the cage sliding door, and engaging members mounted on the mounting plate in a given engagement relationship of the engaging members and the engaging mechanism, wherein the cage of the elevator is set facing the platform, the platform sliding doors and the cage sliding doors are half opened, the mounting plate is slid, and adjustment is made so as to set up the given engagement relationship of the engaging members and the engaging mechanism. Therefore, the present invention provides a method of adjusting an elevator door structure which can adjust the gaps between the vibration damping mechanism and the vibration damping members, in a state that the engaging members engage the engaging mechanism.

What is claimed is:

1. A door structure for an elevator comprising:

a first cage sliding door provided on a cage at an entrance way thereof;

a second cage sliding door provided on the cage, and coupled with the first cage sliding door through a first interlocking means so that the first and second cage sliding doors are movable in opposite directions to each other;

a platform drive door provided on an elevator platform facing the entranceway, and adapted to be driven by the first cage sliding door;

a platform follower door provided on the elevator platform, and coupled with the platform drive door through a second interlocking means so that the platform follower door is movable while confronting with the second cage sliding door;

a vibration damping engaging mechanism provided on the second cage sliding door to confront with the platform follower door, the mechanism being operable in a direction orthogonal to a lifting direction of the cage in association with the opening/closing movement of the second cage sliding door; and a vibration damping member provided on the platform follower door to confront with the second cage sliding door, the vibration damping member being located at such a position as to form gaps on both sides of the vibration damping engaging mechanism, wherein, through the operation of the vibration damping engaging mechanism, when the second cage sliding door is present near to a full open position or a full close position, the gaps are larger than those when the second cage sliding door is present near to the center of the path along which the second cage sliding door runs for opening and closing.

2. The door structure according to claim 1, further comprising:

a link mechanism operable depending on a variation of a position where it engages a cam as the result from the opening/closing movement of the second cage sliding door, wherein, when the second cage sliding door is present near to the full open or full close position as the result from the operation of the vibration damping engaging mechanism by the link mechanism, the gaps between the vibration damping engaging mechanism and the vibration damping member are larger than those when the second cage sliding door is present near to the center of the path along which the second cage sliding door runs for opening and closing.

3. The door structure according to claim 1, further comprising:

a cam turning depending on the opening/closing movement of the second cage sliding door; and a link mechanism operating depending on a variation of a position where it engages a cam as the result from the opening/closing movement of the second cage sliding door, wherein when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing.

4. The door structure according to claim 1, further comprising:

a cam fastened to the second cage sliding door; and a link mechanism operating depending on a variation of a position where it engages the cam as the result from the opening/closing movement of the second cage sliding door, wherein, when the second cage sliding door is present near to the full open or full close position as the result from the operation of the vibration damping engaging mechanism by the link mechanism, the gaps between the vibration damping engaging mechanism and the vibration damping members are larger than those when the second cage sliding door is present near to the center of the path along which the second cage sliding door runs for opening and closing.

5. The door structure according to claim 2, wherein the weight of the vibration damping engaging mechanism with the link mechanism is balanced so as to urge the vibration damping engaging mechanism to increase the gap between the vibration damping engaging mechanism and the vibration damping member.

6. The door structure according to claim 3, wherein the weight of the vibration damping engaging mechanism with the link mechanism is balanced so as to urge the vibration damping engaging mechanism to increase the gap between the vibration damping engaging mechanism and the vibration damping member.

7. The door structure according to claim 4, wherein the weight of the vibration damping engaging mechanism with the link mechanism is balanced so as to urge the vibration damping engaging mechanism to increase the gap between the vibration damping engaging mechanism and the vibration damping member.

8. A door structure for an elevator comprising:

a first cage sliding door provided on a cage at an entrance way thereof;

a second cage sliding door provided on the cage, and coupled with the first cage sliding door through a first interlocking means so that the first and second cage sliding doors are movable in opposite directions to each other;

a platform drive door provided on an elevator platform facing the entranceway, and adapted to be driven by the first cage sliding door;

a platform follower door provided on the elevator platform, and coupled with the platform drive door through a second interlocking means so that the platform follower door is movable while confronting with the second cage sliding door;

a vibration damping engaging mechanism provided on the second cage sliding door to confront with the platform follower door, and operable in a direction orthogonal to a lifting direction of the cage in association with the opening/closing movement of the second cage sliding door; and a vibration damping member provided on the platform follower door to confront with the second cage sliding door, the vibration damping member being located at such a position as to form gaps on both sides of the vibration damping engaging mechanism, wherein, through the operation of the vibration damping engaging mechanism, when the second cage sliding door runs in a low speed mode where the second cage sliding door is accelerated or decelerated, the gaps are larger than those when the second cage sliding door runs in a high speed mode.

9. A method of adjusting a door structure for an elevator having a platform sliding door provided at the entranceway of a platform of an elevator, a cage sliding door provided at the entranceway of a cage, an engaging mechanism, provided on the cage sliding door in opposition to the platform sliding door, being movable in the direction orthogonal to the lifting direction of the cage, in connection with the opening/closing movement of the cage sliding door, a mounting plate movably mounted on the platform sliding door in opposition to the cage sliding door, and engaging members mounted on the mounting plate in a given engagement relationship of the engaging members and the engaging mechanism, wherein the cage of the elevator is set facing the platform, the platform sliding doors and the cage sliding doors are half opened, the mounting plate is slid, and adjustment is made so as to set up the given engagement relationship of the engaging members and the engaging mechanism.

10. A door structure for an elevator comprising:

a first door provided on a cage of the elevator and laterally movable between a full opened position and a full closed position to open and close an entranceway of the elevator;

a second door provided on an elevator platform, and associated with the first door so that the first and second doors are laterally moved while confronting with each other;

a vibration damping member provided on the second door to confront with the first door, and having a pair of damping elements laterally spaced with respect to each other to define a first lateral gap therebetween;

a vibration damping engaging mechanism provided on the first door to confront with the second door, the mechanism having a pair of variable gap defining elements for defining a variable, second lateral gap therebetween within the first lateral gap; and cam and cam follower means for driving at least one of the variable gap defining elements so that the second lateral gap is first increased and then decreased during the course of movement of the first door from one of the full opened and closed positions to the other.

11. The door structure according to claim 10, wherein one of the variable gap defining elements is inclined relative to the other of the variable gap defining elements when the first door is located at either of the full opened position and the full closed position.

12. The door structure according to claim 10, wherein the pair of the variable gap defining elements keep being parallel to each other during the course of movement of the first door from one of the full opened position and closed positions to the other.

13. The door structure according to claim 12, wherein both of the variable gap defining elements are movable relative to the first door.

14. The door structure according to claim 10, wherein the vibration damping member including a mounting plate supporting the pair of the damping elements thereon, and the mounting plate is adjustably fixed to the second door through laterally elongated holes and fixing bolts.

* * * * *